US006974783B2

(12) United States Patent
Akdogan et al.

(10) Patent No.: US 6,974,783 B2
(45) Date of Patent: Dec. 13, 2005

(54) FLEXIBLE INTERMEDIATE BULK CONTAINER

(75) Inventors: I. Selim Akdogan, Fernerbahce-Istanbul (TR); Nurettin Guengoer, Maltepe-Istanbul (TR); Peter Trepte, Emsdetten (DE)

(73) Assignee: Unsa Ambalaj Sanayi Ve Ticaret A.S., Samandira/Instanbul (TR)

( * ) Notice: Subject to any disclaimer, the term of this patent is extended or adjusted under 35 U.S.C. 154(b) by 0 days.

(21) Appl. No.: 10/299,102

(22) Filed: Nov. 14, 2002

(65) Prior Publication Data

US 2004/0076791 A1 Apr. 22, 2004

(30) Foreign Application Priority Data

Oct. 16, 2002 (EP) ..... 02023236

(51) Int. Cl.[7] ..... B32B 27/04; B32B 27/12; B32B 5/02

(52) U.S. Cl. ..... 442/110; 428/90; 428/113; 428/373; 428/375; 428/397; 428/400

(58) Field of Search ..... 442/110; 428/90, 428/113, 373, 375, 397, 400

(56) References Cited

U.S. PATENT DOCUMENTS

| | | | | |
|---|---|---|---|---|
| 3,769,815 | A * | 11/1973 | Ploch et al. | 66/85 A |
| 4,431,316 | A | 2/1984 | Massey | |
| 5,071,699 | A | 12/1991 | Pappas et al. | |
| 5,213,865 | A * | 5/1993 | Yamada | 428/92 |
| 5,458,419 | A | 10/1995 | Trepte et al. | |
| 5,679,449 | A * | 10/1997 | Ebadat et al. | 442/110 |
| 6,245,694 | B1 * | 6/2001 | Davenport et al. | 442/110 |
| 2002/0039631 | A1 | 4/2002 | Wurr et al. | |

FOREIGN PATENT DOCUMENTS

JP 2001/1315894 11/2001

* cited by examiner

*Primary Examiner*—Norca L. Torres-Velazquez
(74) *Attorney, Agent, or Firm*—Jordan and Hamburg LLP

(57) ABSTRACT

A flexible, intermediate, bulk, container includes coated or uncoated woven fabric or plastics film having antistatic properties and is provided with elements which are enabled for corona discharge of static electricity accumulating in the flexible, intermediate, bulk, container, the surface of the woven fabric or plastics film at least partially comprising fibers protruding less than 10 mm from the surface.

30 Claims, 8 Drawing Sheets

FLEXIBLE INTERMEDIATE BULK CONTAINER

BACKGROUND OF THE INVENTION

This invention refers to a flexible, intermediate, bulk container made of coated or uncoated woven fabric or plastics film having antistatic properties. The container is equipped with elements which are enabled for corona discharge of static electricity accumulating in said container.

Flexible, Intermediate, Bulk Containers are specified in European Standard EN 1898, which was approved by CEN on 15 Jun. 2000 and which is incorporated herein by reference. In this European Standard, it is mentioned that such FIBCs may be subject of special electrostatic conductivity treatment, however, there is no further statement about the generation of electrostatic charges and advantageous designs which reduce the risks resulting from such generated electrostatic charges.

A flexible, intermediate, bulk container (FIBC) is also disclosed in U.S. Pat. No. 5,071,699. Segregation processes of moving product particles as well as segregation created between the product particles and the FIBC during filling and emptying of the FIBC create localized pockets of built-up static electricity in the FIBC. Incendiary discharges from the charged FIBC can be dangerous when combustible dust arises inside the FIBC and/or in a hazardous area with explosive dust-air mixtures or explosive gas/vapour/mist-air mixtures, and can be quite uncomfortable to workers handling such containers. To avoid these disadvantages, it is suggested that the woven fabric of the FIBC should contain a plurality of interwoven quasi conductive filament fibers. The purpose of the quasi conductive fibers is to more evenly distribute the electrostatic charges which may build up on the surfaces and to effect corona discharges at the ends of the filament fibers. Preferably, the fibers are interwoven at regular intervals so that they are evenly spaced apart across the surface of the fabric. Such FIBCs need not be grounded during filling and emptying operations. As static charges are generated, the electrons can bleed into the atmosphere. Dangerous electrostatic charges are reduced but not eliminated.

A similar approach is disclosed in U.S. Pat. No. 5,458,419. An FIBC is equipped with a grid of interconnected conductive filaments and can be grounded via a conductive grounding tab and/or the conductive lifting loops. The FIBC must be grounded during filling and emptying to discharge and to eliminate the dangerous electrostatic charges. However, grounding is additional work which should be avoided and, if the grounding is improperly done, risks from static electricity still prevail.

The bleeding effect of electrons into the atmosphere is known to experts as corona discharge. Several types of discharge are distinguished in electrostatics on a purely phenomenological basis, that depends on the conductivity and geometric arrangement of the charged objects. This distinction is of great significance for industrial practice in as much as each type of gas discharge exhibits a different incendivity towards flammable atmospheres. Generally, four types of discharge exist:

spark discharge,
brush discharge,
propagating brush discharge, and
corona discharge.

The corona discharge can be understood as a special case of a brush discharge. If the radius of curvature of the grounded electrode which is introduced in a powerful electric field is very small, for example less than 1 mm, the field is disturbed only in the immediate vicinity of the pointed electrode. This gives rise to a very weak gas discharge restricted to the immediate vicinity of the point, which, in contrast to a brush discharge, is not triggered abruptly and does not lead to visible discharge channels. Depending on the quantity and replenishment rate of the charge carriers that generate the field, a corona discharge shows a more or less constant discharge over a lengthy period of time and hence must be regarded as a continuous gas discharge.

The quasi conductive fibers interwoven with the fabric of the FIBC disclosed in the a.m. prior art collect the locally accumulated electrostatic charges. The electrostatic charge now contained in the quasi conductive fibers is transmitted to their discharge points which are at the ends of the fibers. At these ends the corona discharge mainly occurs. The disadvantage of the containers known from prior art is the relatively long time period which is required to achieve a neutralized charge status at the ends of the quasi conductive fibers. For some applications it takes too long before a high electrostatic charge is eliminated by corona discharge at the ends of the quasi conductive fibers interwoven with the fabric.

SUMMARY OF THE INVENTION

Accordingly, it is an object of this invention to accelerate the discharge process for FIBCs by improved means for discharging the dangerous electrostatic charges. The problem is solved if the surface of the woven fabric or plastics film at least partially comprises fibers protruding less than 10 mm from the surface.

According to another embodiment of the invention, the woven fabric or plastics film at least partially comprises fibers with a length of less than 10 mm. In those areas where localized pockets of built-up static electricity are created, each end of such fiber protruding less than 10 mm from the surface of an FIBC can act as an electrode for a corona discharge. A minimal protrusion of at least 0.1 mm should be realized. With a plurality of such fibers, a plurality of corona discharge effects may occur, and accordingly the speed of discharge is substantially accelerated by the figure of electrodes available for the discharging process. With an even distribution of short fibers across the outer surface of an FIBC, this advantage is achieved for the whole FIBC.

The antistatic properties of the coated or uncoated woven fabric or plastics film allow a distribution of the surface charge from a pocket of built-up static electricity towards the area where the fibers with a length shorter than 10 mm are arranged. Depending from the application, it may be sufficient to arrange the short fibers in more or less regular distant intervals. Due to the faster discharge of static electricity and the more even distribution of the discharging process across the whole surface of the FIBCs equipped with the inventive short fibers, a safer handling is achieved. The margins of safe use of respective FIBCs are expanded, and depending from the materials which are to be filled into the FIBCs and the present environment during the filling and transport process, new materials are admissible for transport in FIBCs, or known materials may be filled and transported with lower safety precautions. The grounding of the FIBC during filling and emptying can even be void with the new FIBCs for special materials, which require today FIBCs of prior art which have to be grounded. Generally, the FIBC equipped with the inventive design can be used without grounding in applications with explosive dust-air mixtures or with explosive gas/vapour/mist-air mixtures in the surrounding, which is including hazardous areas Zone 1, 2, 21, 22 according to EN 13463. As a result, the efficiency and safety of using FIBCs without grounding is substantially increased.

A more complete understanding of the invention may be had by referring to the examples contained in the following description of the invention, the drawings and the elements contained in the claims.

IN THE DRAWINGS

Figure 3:
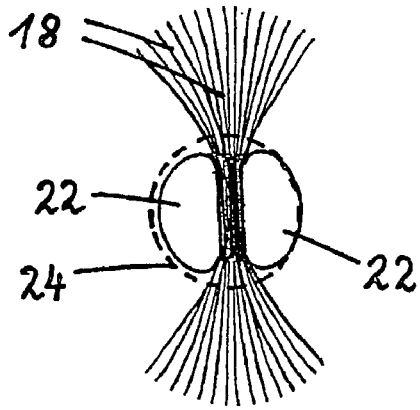
Figure 4:
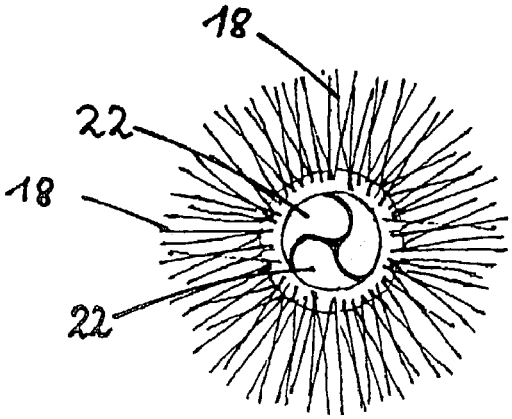
Figure 5:
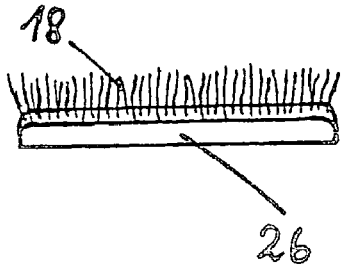
Figure 6:
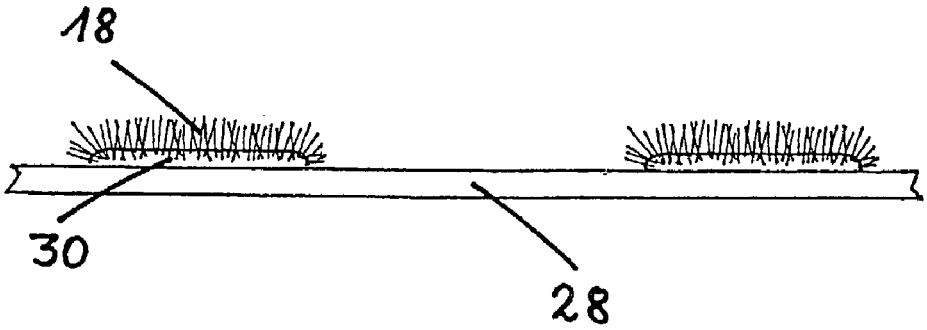
Figure 7:
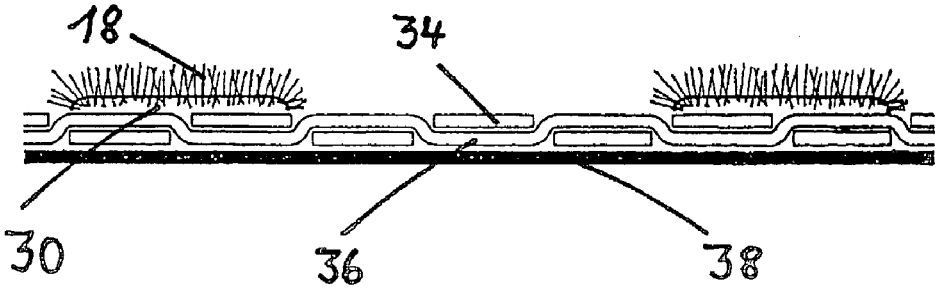
Figure 8:
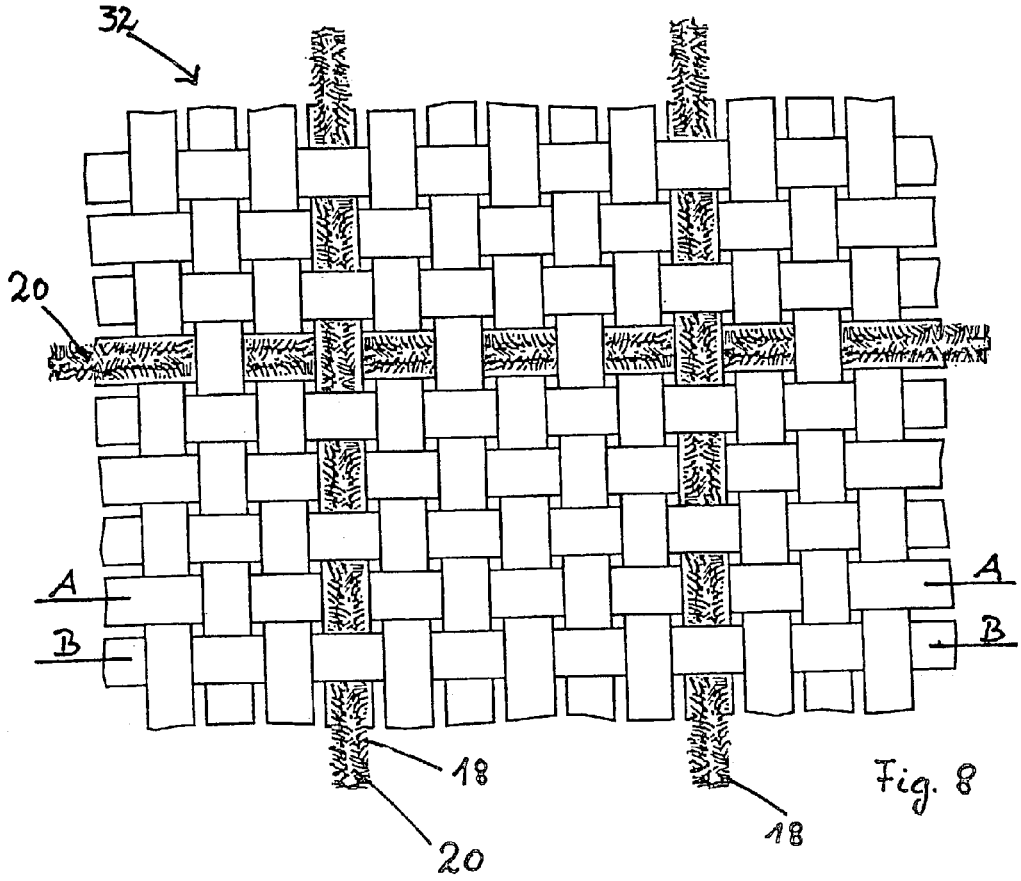
Figure 9A:
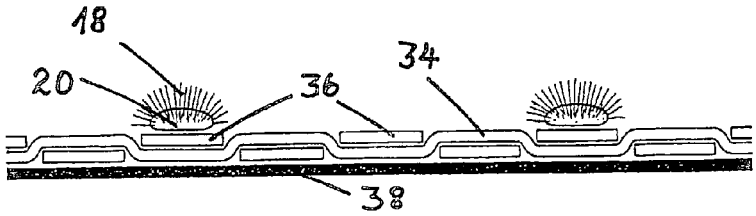
Figure 9B:
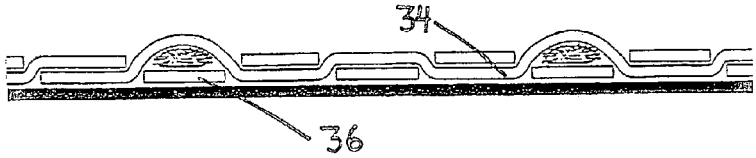
Figure 10:
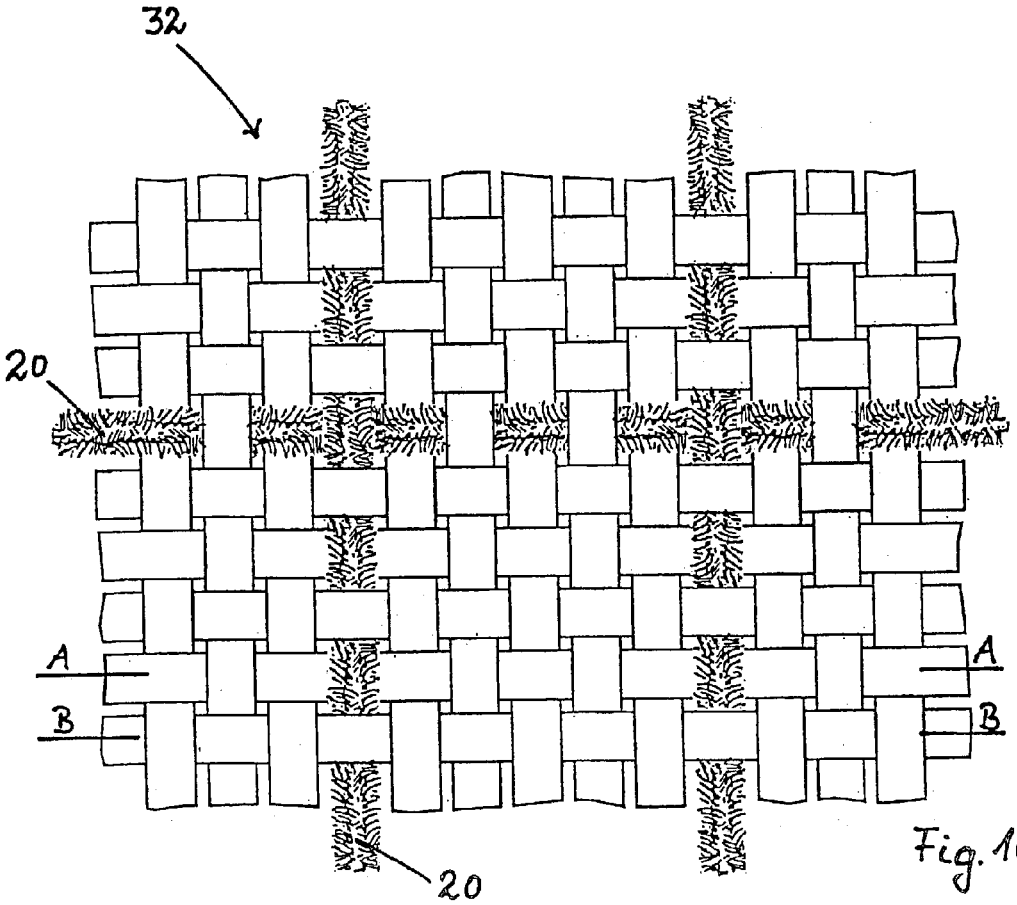
Figure 11A:
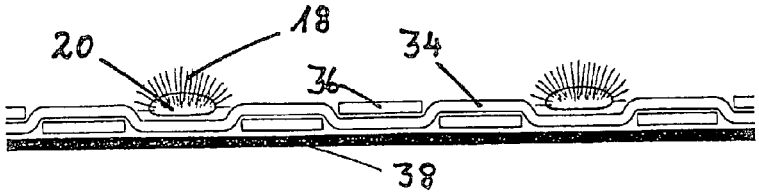
Figure 11B:
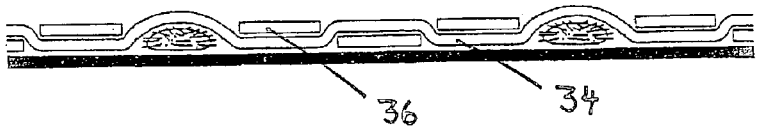
Figure 12:
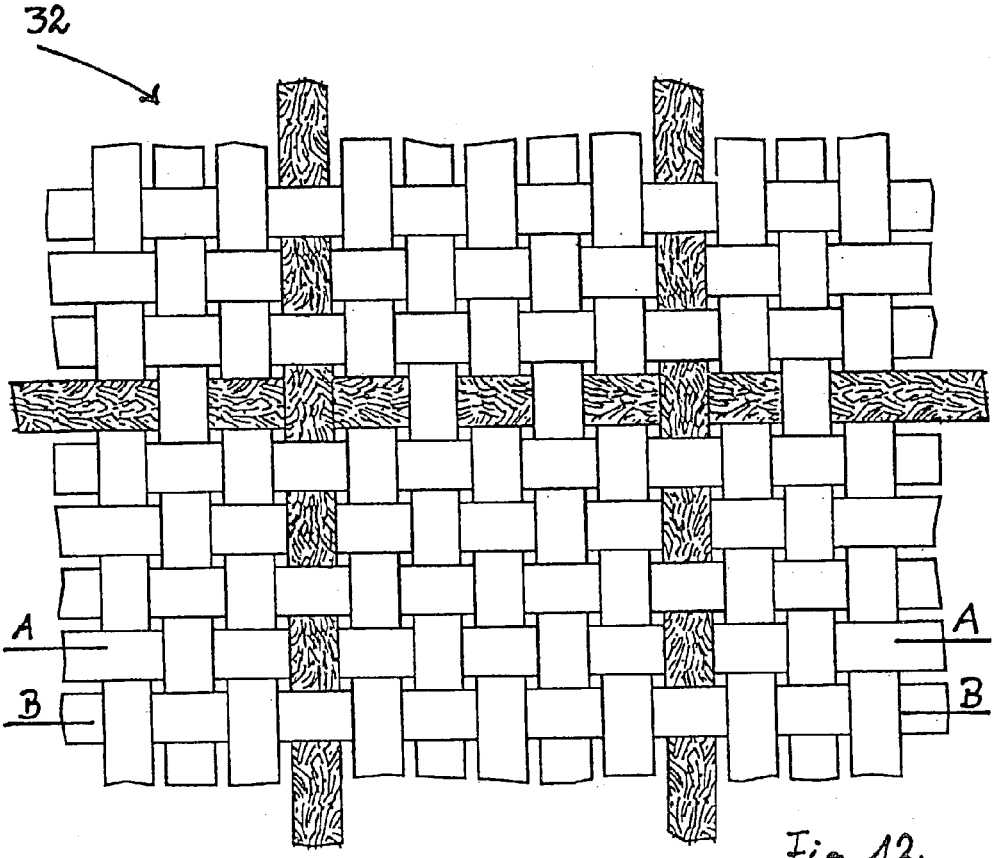
Figure 13A:
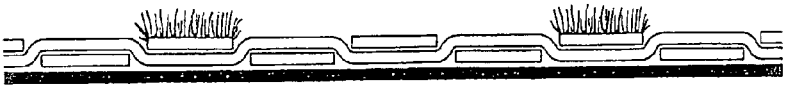
Figure 13B:
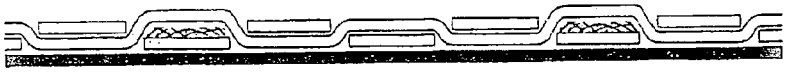
Figure 14:
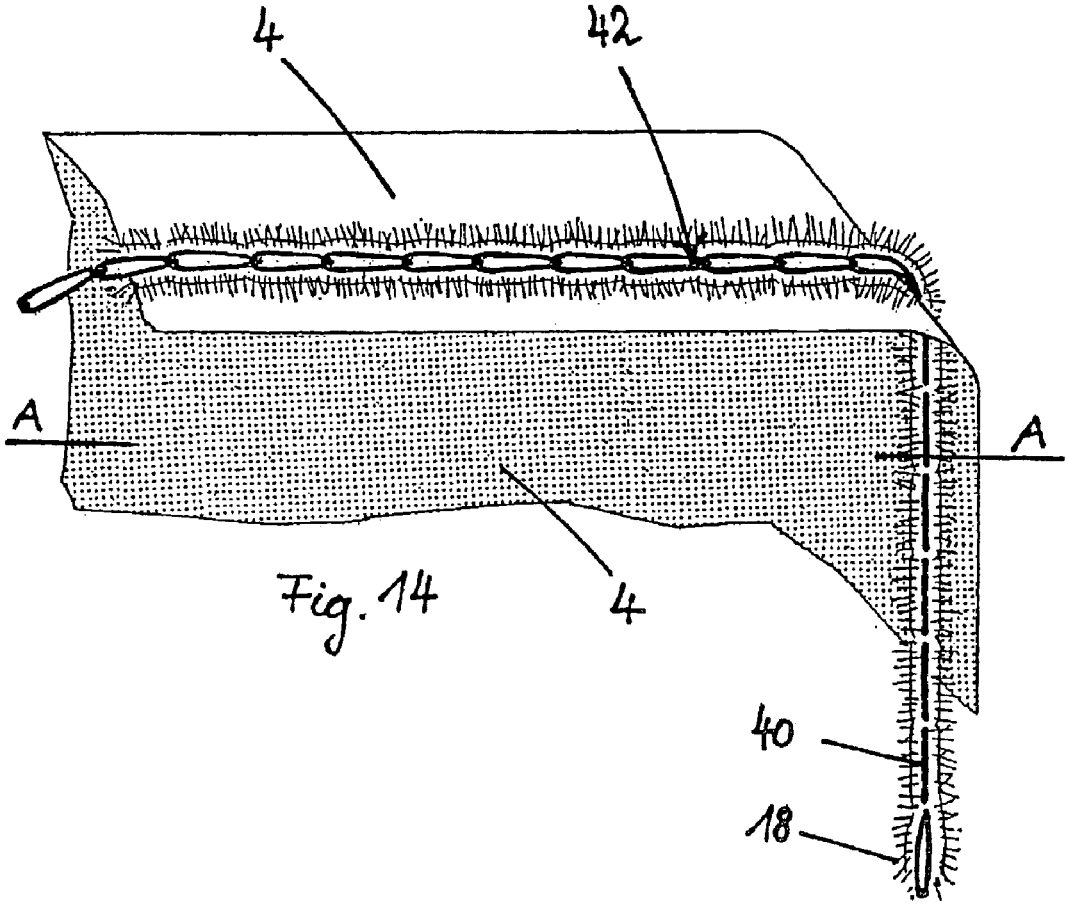
Figure 15:
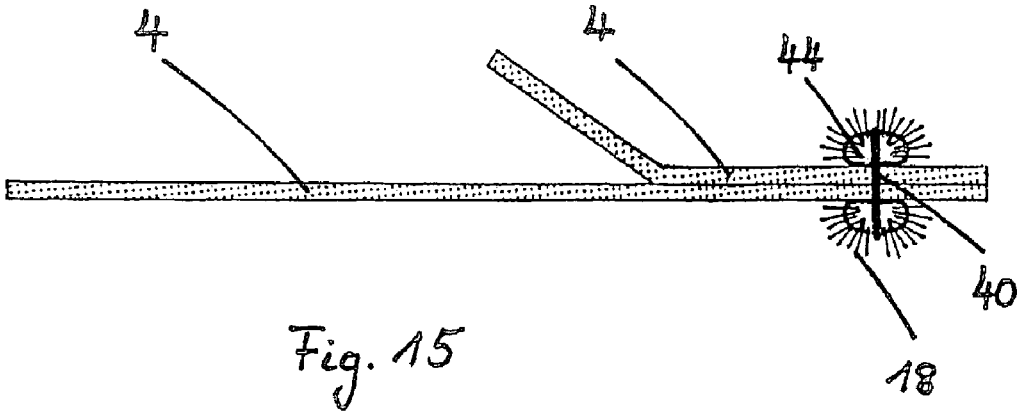
Figure 16:
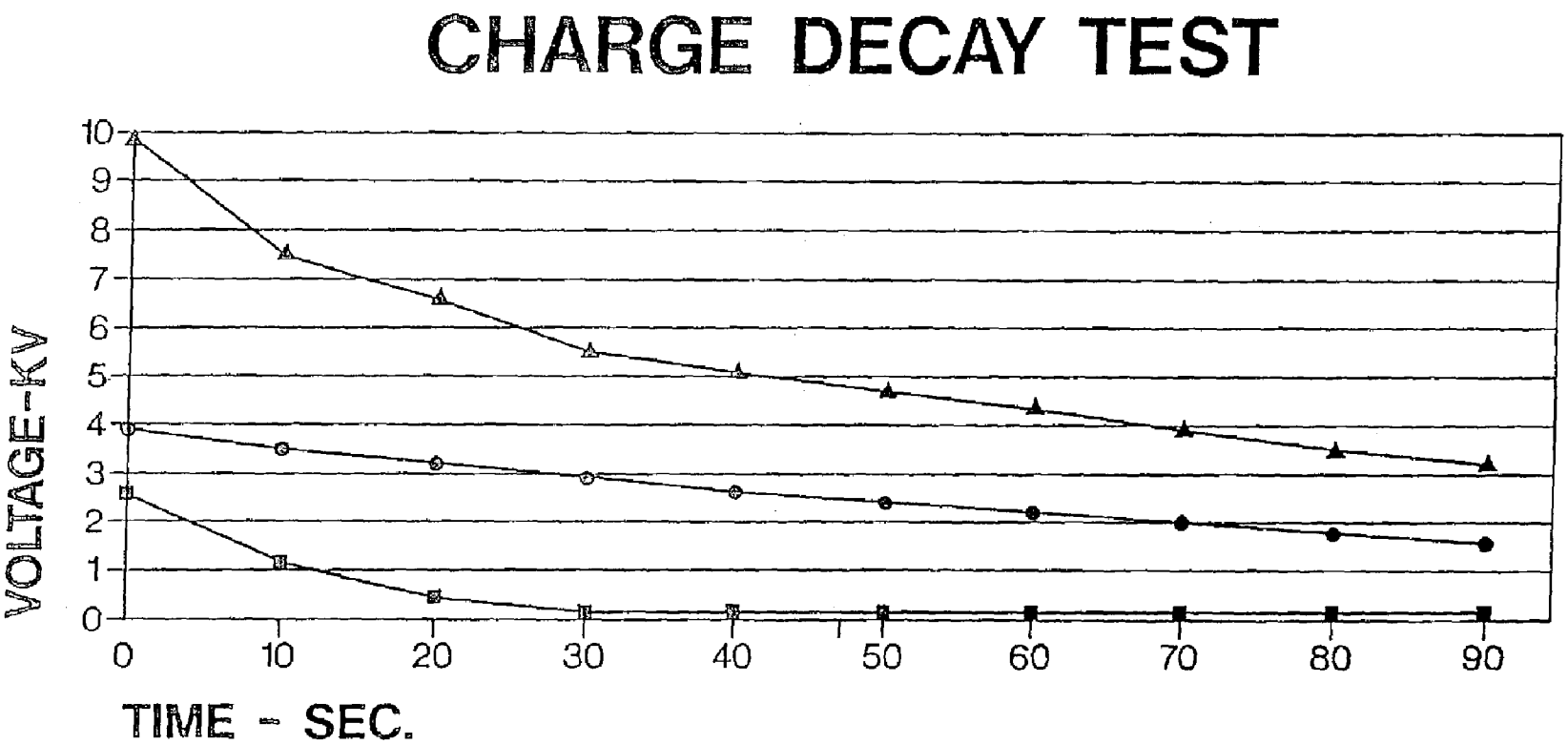

FIG. 3 shows a cross-sectional view of a yarn which comprises short fibers with ends which laterally protrude, FIG. 4 shows a cross-sectional view of a flocked yarn, FIG. 5 shows a cross-sectional view of a flocked film tape, FIG. 6 shows a cross-sectional view of a partially flocked plastics film, FIG. 7 shows a cross-sectional view of a partially flocked woven fabric, FIG. 8 shows a view of the surface of a section of woven fabric containing yarn with short fibers which is assigned to and interwoven with warp and weft flat film tape material, FIGS. 9A and 9B show cross-sectional views of the woven fabric shown in FIG. 8, FIG. 10 shows a view of the surface of a section of woven fabric containing yarn with short fibers which substitutes flat film tape material in the woven fabric, FIGS. 11A and 11B show cross-sectional views of the woven fabric shown in FIG. 10, FIG. 12 shows a view of the surface of a section of woven fabric containing flat film tapes with short fibers, which substitutes flat film tape material in the woven fabric, FIGS. 13A and 13B show cross-sectional views of the woven fabric shown in FIG. 12, FIG. 14 shows a view of a dust-proof cord with laterally protruding fibers in a stitched seam or joint, FIG. 15 shows a cross-sectional view of a stitched seam or joint shown in FIG. 14, and FIG. 16 shows a diagram of the charge decay of different samples.

DESCRIPTION OF THE PREFERRED EMBODIMENTS

Figure 1:
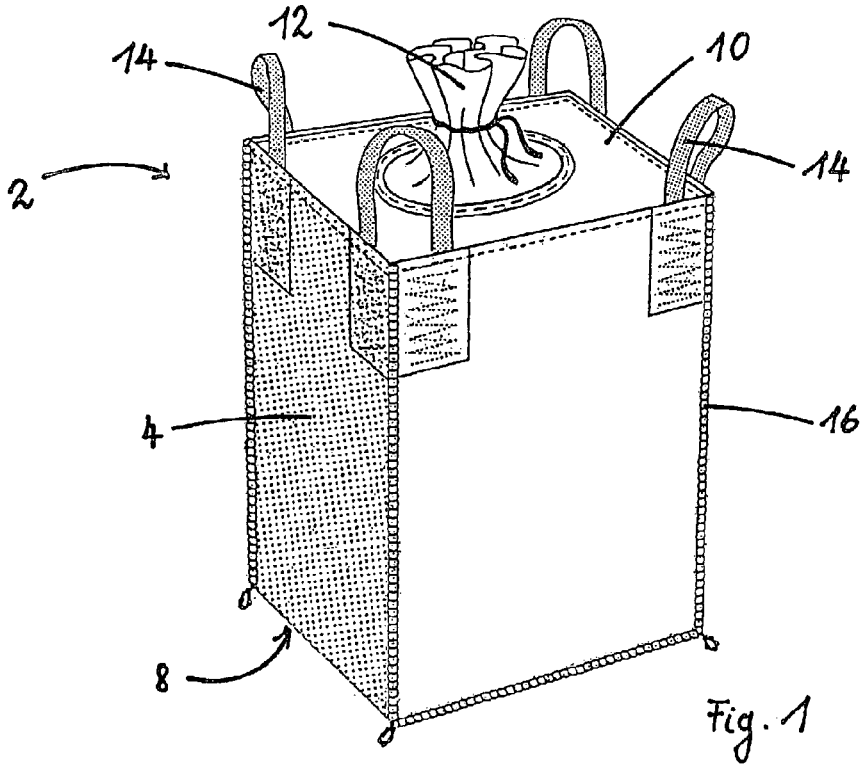
FIG. 1 shows a view of an FIBC with walls made of flat woven fabric.
Figure 2:
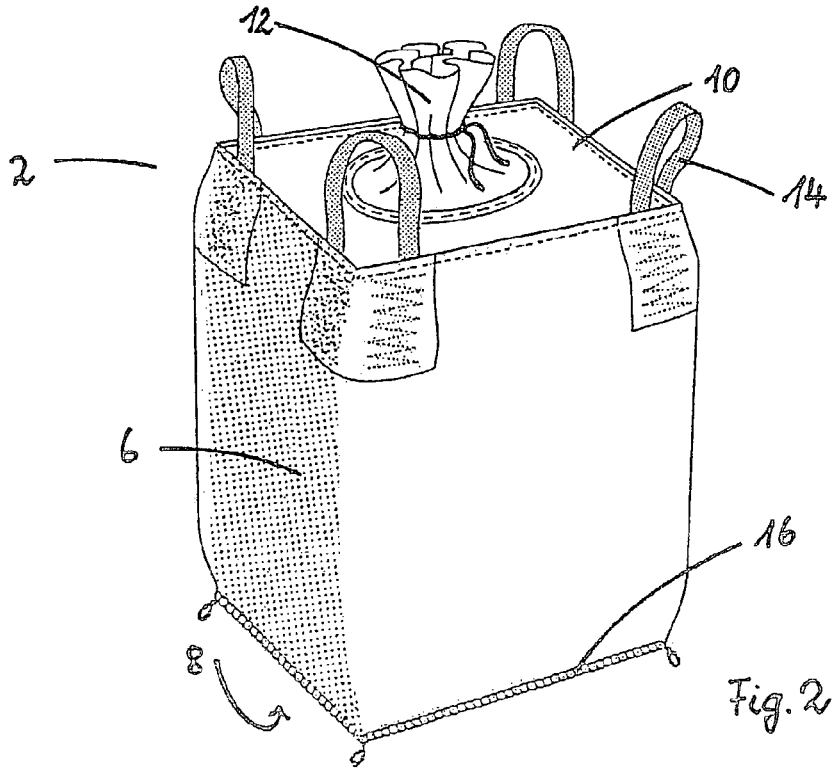
FIG. 2 shows a view of an FIBC with walls made of circular woven fabric.

The FIBC 2 shown in FIGS. 1 and 2 as an example is made of flexible material such as woven fabric or plastics film, designed to be in contact with the contents, either directly or through a coating, and collapsible when empty. There are many types of FIBC 2 available on the market with different designs, measures, safe working loads, safety factors and lifting devices. The FIBC 2 consists of walls, which may be provided by one or more panels 4 joined together and as shown in FIG. 1, or a tube 6 of one or more layers as shown in FIG. 2, and further a base 8 which is connected to or integral with the walls and forms the base of the standing FIBC 2, a top 10 which forms the upper part of the FIBC 2 after closing.

For operation of the FIBC 2, it may be equipped with filling devices 12 like a spout or a slit, discharging devices like spouts or other closing parts and handling devices 14 like one or more webbings, loops, ropes, eyes, frames or other devices formed from a continuation of the walls of the FIBC or which are integral or detachable, and are used to support or lift the FIBC. Usually, stitched seams 16 and joints are locked off and/or back sewn or provided with a minimum 20 mm tail. Surfaces may be joined by welding, gluing or heat-sealing. The FIBC may provide a special treatment by the addition of ultra violet absorbers and/or antioxidants, flame retardants, insect repellents and the like.

When selecting an FIBC 2 for use, consideration is given to the physical and chemical properties of the intended contents of the FIBC 2, such as bulk density, flow characteristics, degree of aeration, particle size and shape, compatibility with the materials used for the construction of the FIBC 2, fill temperature and whether the intended contents are foodstuffs, when special conditions normally apply. Further consideration is directed to the methods to be used for filling, handling, transporting, storing and emptying the FIBC 2, and general environmental considerations. All aspects mentioned may have a direct or indirect influence upon the creation of static electricity on the inner and/or outer surface of the FIBC 2.

To achieve a faster decrease of electrostatic charge accumulated in the FIBC 2, the surface of the woven fabric or plastics film from which the FIBC 2 is made, at least partially comprises fibers 18 which are protruding from the surface of the FIBC by less than 10 mm. Such protruding short fibers 18 are made from antistatic material. The electric resistance of the fibers 18 itself and the glue 30 and the yams, cords and film tapes with incorporated or flocked fibers should preferably be equal or lower than the electric resistance of the tapes, the yams and coating of the basic weave. The said electric resistance is preferably in the range of $10^8$ to $10^{12}$ ohm/cm. The coating 38 and the woven fabric and plastics film have preferably a surface resistance in the range of $10^8$ to $10^{12}$ ohm. The general term "yarns" means all kind of yams made of, but not limited to, filaments or spun fibers, and irrespective, whether used in straight form or twisted, woven, blended, knotted, or treated in any other way. Short fibers 18 are preferably arranged in proximity to a local pocket of built-up static electricity. The short fibers 18 are either in direct contact with the local electric field, or due to the antistatic properties of the woven fabric or plastics film the electricity may move to the short fibers 18.

The short fibers 18 are in one embodiment flocked to the woven fabric or plastics film of the FIBC 2. In a different embodiment, yarn or film tape material which is interwoven or applied to the woven fabric or plastics film comprises such short fibers 18. There are now some examples introduced how the short fibers 18 can be attached to the FIBC 2 in an efficient way.

In FIG. 3 there is a cross-sectional view upon a twofold yarn 20 which is twisted and engages short fibers 18. The yarn 20 is formed from single yarns 22, which hold short fibers 18 between them. The short fibers 18 protrude from the center cross-section 24 of yarn 20. The center cross section 24 is identified by a circle. With the term "center cross section" that part of yarn is meant which forms the tight core of a complete yarn, whereas the protruding fibers 18 may be more soft and elastic and may be generally arranged in a non-aligned way. Each single end of a short fiber 18 is a pointed electrode which allows a weak gas discharge. By the multiple short fibers 18 which are engaged between the yarns 22, there are many pointed electrodes and each of them is capable of initiating a corona discharge. Seen from the length of yarn 20, there may be arranged thousands of short fibers 18 on a short distance. The discharge activity of the multiple short fibers 18 adds up to a very fast charge decay in the local pocket where the short fibers 18 are arranged in proximity.

The short fibers 18 may receive their current by direct contact to the local pocket of static electricity or via the antistatic coated or uncoated woven fabric of the FIBC 2, or via the antistatic yarns 22, and they have distributed the current from a more distant location to the location shown in FIG. 3. Such yarn 20 may be interwoven into the woven fabric or a plastics film, so that the electrostatic charge accumulated on the interior surface of the FIBC 2 is transmitted towards the outer surface of FIBC 2.

The yarn 20 shown in FIG. 3 can be manufactured by laying short fibers 18 between the contacting surfaces of a twofold yarn 22. The short fibers 18 are fixed in their position between the yarns 22 and the fibers are laterally protruding. Such yarn is available on the market under the name "chenille yarn", but there are also other effect yarns with other designs and laterally protruding fibers on the market.

In FIG. 4 there is shown a cross-sectional view upon a flocked yarn 20 which comprises flock as short fibers 18 at the outer surface of the yarn 22. The yarn 20 may be a threefold yarn 22, or of different design. The short fibers 18 only stick on the outer surface of the center cross section 24 of yarn 20. They are not engaged between the surfaces where the three yarns 22 contact each other.

In FIG. 5 there is shown a cross-sectional view upon a film tape 26 which comprises short fibers 18 as flock. An electric charge can be distributed by the direct contact of short fibers 18 with itself, but also by the antistatic film tape 26.

FIG. 6 shows a cross-sectional view upon a partially flocked plastics film 28. The short fibers 18 are kept in place by an antistatic layer of glue 30. An electrostatic charge existing at the inner surface of the plastics film 28 may spread via the antistatic plastics film and the antistatic layer of glue to the short fibers 18 and dissipate by a corona discharge into the gas atmosphere surrounding the outer surface of the FIBC, where the short fibers 18 are directed to from the surface of the plastics film 28.

In FIG. 7 a cross-sectional view upon a woven fabric 32 partially covered with flock as short fibers 18 can be seen. The woven fabric 32 consists of warp film tape 34 and weft film tape 36, which are interwoven. Also a coating 38 can be seen. The flock is attached to the surface of the woven fabric 32 by a glue 30. The short fibers 18 are attached to the surface of the woven fabric 32 in a way that one end of them protrudes again towards the atmosphere around the outer surface of FIBC 2.

FIG. 8 shows a view upon the surface of a section of woven fabric 32. The woven fabric contains yarn 20 with short fibers 18, which are assigned to and interwoven with warp and weft flat film tape material 34, 36 of the woven fabric 32, so that the yarn 20 alternately appears on the outer and on the inner surface of the FIBC 2. Sections of parallel and crossing lines of yarn 20 form a boundary around certain areas of the woven fabric 32. Electrostatic charges accumulating in such certain areas shall be dissipated towards the yarn 20 and discharged by the short fibers 18 contained in the yarn 20. If the yarn 20 is arranged in parallel lines and these lines keep an even distance of up to 80 mm, preferably 20 mm between them, a satisfactory corona discharge of the woven fabric 32 can be also achieved. The yarn 32 can also be arranged in a way that the lines of yarn 20 cross each other in warp and weft direction of the woven fabric and a certain area encircled by sections of yarn 20 shows a rectangular form.

FIGS. 9A and 9B show a cross-sectional view upon the woven fabric 32 shown in FIG. 8 along the lines A—A and B—B. It can be seen that the short fibers 18 of yarn 20 protrude from the surface of the woven fabric 32 into the outer atmosphere around the FIBC 2. The interior surface of FIBC 2 is covered with a coating 38.

In FIG. 10 a view upon the surface of a section of woven fabric 32 containing yarn 20 with short fibers 18 is shown, which substitutes flat film tape material in the structure of the woven fabric.

FIGS. 11A and 11B show a cross-sectional view upon the woven fabric 32 shown in FIG. 10 along the lines A—A and B—B. Again, the short fibers 18 arranged on the outer surface of the woven fabric 32 of FIBC 2 are directed into the outer atmosphere so that the electric current may bleed into the atmosphere by corona discharge. Those short fibers 18 which are arranged on the inner surface of the woven fabric 32 are in direct contact with the film of the coating 38, which eases the exchange of electrons between the coating 38 and the short fibers 18.

In FIG. 12, the surface of a section of woven fabric 32 containing flat film tapes 26 with flocked short fibers 18 is shown, which substitutes usual flat film tape material in the woven fabric 32. FIGS. 13A and 13B show a cross-sectional view upon the woven fabric shown in FIG. 12 along the lines A—A and B—B. Generally, the comments made to FIGS. 8 to 12 apply accordingly.

In FIG. 14 a view upon an antistatic seam sealing cord 40 with laterally protruding short fibers 18 in a stitched seam 42 or joint can be seen. By using a cord 40 which comprises short fibers 18 the short fibers 18, are on the one hand in direct contact with the panels 4 and can collect electrostatic charges from inside of the FIBC via the antistatic panels, and on the other hand end of the fibers 18 are directed into the outer atmosphere surrounding the FIBC 2, so that these multiple ends of short fibers 18 can act as corona discharge electrodes.

FIG. 15 shows a cross-sectional view upon a stitched seam 42 or joint shown in FIG. 14 along the line A—A. In the cross-sectional view it can easily be seen how the two panels 4 are joined by seam 42. Again, the short fibers 18 are protruding into the surrounding atmosphere so that they can act as electrodes for a corona discharge. A seam sealing cord 44 is positioned on the stitching holes of seam 42 to achieve a dust proof FIBC 2.

FIG. 16 shows a diagram of the charge decay of different samples. It can be seen that a standard antistatic fabric 32 shows an initial drop of voltage, but maintains charge over the measurement cycle. A better charge decay can be seen with the antistatic fabric with interwoven quasi-conductive filament fibers. The best result is achieved with a sample, where the short protruding fibers are evenly distributed over the surface of the antistatic woven fabric 32. Here the charge has disappeared after a short time of 30 seconds. This charge decay is much faster than the cycle times of FIBCs known from prior art.

To enable an additional grounding, the yarns comprising fibers 18 and/or film tape material comprising fibers 18 and/or cords comprising fibers 18 are electrostatically dissipative and/or antistatic and are interconnected and allow the discharge of electrostatic charges via electrostatically dissipative lifting loops and/or via conductive grounding tabs. When filling and emptying the FIBC, additional safety can be achieved by such grounding because the corona discharge of the FIBC is reduced. The danger of induced charging of insulated parts and persons in the surrounding of the FIBC is essentially reduced. Thus the grounded inventive FIBC has as well the advantages of an FIBC which is discharged by grounding only, as well as the advantages of an FIBC which is discharged by corona discharge only.

In a further embodiment not shown in the drawings, spun fiber yarns or spun yarn with blended fibers or additional short fibers 18 can be used to achieve the effect of a plurality of electrodes by many small fiber ends. Spun fiber yarn consists of multiple fibers, which may also be longer than 10 mm, but which may be spun in a way that at least one end of a fiber protrudes from the cross sectional center circle of the yarns by more than 0.1 mm. Such protruding sections of spun fiber yarns show an identical effect like the short fibers 18 described above, and the end sections of such fibers are also within the scope of this invention, if they function also as electrodes for a corona discharge.

As a summary, flocked yarns with flock fiber on their surface, chenille yarns and other effect yarns with a functionally comparable fiber design of short fibers 18 engaged between the long fibers or filaments, film tape yarns flocked or equipped in other ways with short fibers 18, tufted yarns, all being worked into woven fabric or plastics film as material of an FIBC 2, are all applications of this invention described above. By using short fibers 18 as electrodes for a corona discharge the charge decay can drastically be accelerated. To achieve the function of electrodes, at least one end of short fibers 18 should be directed into the surrounding atmosphere. The short fibers 18 can be arranged in multiple ways on the surface of an FIBC, and there are many ways how an expert would fix these short fibers 18 on or in an FIBC. All variations are admissible, whether the yarn is interwoven only in warp or weft direction or in both directions or only areas of short fibers 18 are attached to the FIBC, whether different kinds of yarns and/or attached short fibers 18 are used in one single FIBC, whether the yarn and/or the short fibers 18 comprise only antistatic or electrostatically dissipative properties, whether the FIBC is coated or uncoated, whether the short fibers 18 are precisely cut to one identical length or whether the short fibers 18 have different lengths, whether the yarns are made by twofold or multifold yarns, all of these variable aspects will be considered when an FIBC is equipped with short fibers according to this invention. In a further embodiment, not only the body of the FIBC itself, but also labels, document pockets and other polymeric parts fastened to the FIBC can be equipped accordingly.

What is claimed is:

1. Flexible intermediate bulk container comprising coated or uncoated woven fabric or plastics film having antistafic properties and provided with elements which are enabled for corona discharge of static electricity accumulating in said flexible intennediate bulk container, the surface of the woven fabric or plastics film at least partially comprising fibers protruding less than 10 mm from the surface, said fibers having an electric resistance in a range of about $10^8$ to about $10^{12}$ ohm/cm.

2. Flexible intermediate bulk container comprising coated or uncoated woven fabric or plastics film having antistatic properties and provided with elements which are enabled for corona discharge of static electricity accumulating in said flexible intermediate bulk container, the woven fabric or plastics film at least partially comprising fibers with a length of less than 10 mm, said fibers having an electric resistance in a range of about $10^8$ to about $10^{12}$ ohm/cm.

3. Flexible intermediate bulk container according to claim 1 or 2 wherein the woven fabric or plastics film and/or the basic weave carrying the fibers is less or equal electrostatically dissipative than the fibers.

4. Flexible intermediate bulk container according to claim 1 or 2 wherein the fibers are engaged between yarns or flocked to yarns and/or laterally protruding from other designs of yams which are woven into the woven fabrics.

5. Flexible intermediate bulk container according to claim 1 or 2 wherein the fibers are either flocked to the surface or incorporated in the material of the woven fabric or plastics film.

6. Flexible intermediate bulk container according to claim 1 or 2 wherein the fibers are arranged such that their outer ends are generally directed towards the outer atmosphere around the flexible intermediate bulk container.

7. Flexible intermediate bulk container according to claim 1 or 2 further comprising webbing, fabric, loops or ropes used as handling devices which are at least partially flocked or tufted with additional fibers and/or have partially interwoven yams or film tape material comprising the additional fibers, said additional fibers protruding from a base material of the handling devices.

8. Flexible intermediate bulk container according to claim 1 or 2 further comprising antistatic flat and/or round seam sealing cords which comprise protruding fibers.

9. Flexible intermediate bulk container according to claim 1 or 2 further comprising labels, document pockets and other polymeric parts fastened to the flexible intermediate bulk container which at least partially comprise other fibers and/or are treated to achieve antistatic properties.

10. Flexible intermediate bulk container according to claim 1 or 2 further comprising yarns including the fibers and/or film tape material including the fibers and/or cords including the fibers, wherein said yarns, said film tape material and said cords are electrostatically dissipative or antistatic, and are interconnected so as to additionally allow the discharge of electrostatic charges via electrostatically dissipative lifting loops and/or conductive grounding tabs.

11. A flexible intermediate bulk container comprising:

coated or uncoated woven fabric or plastics film, said fabric or film includinig antistatic properties and being provided with elements, said elements being enabled for corona discharge of static electricity accumulating in said flexible intermediate bulk container; and a surface of said woven fabric or plastics film comprising fibers protruding less than 10 mm from said surface said fibers having an electric resistance in a range of about $10^8$ to about $10^{12}$ ohm/cm.

12. The flexible intermediate bulk container of claim 11 wherein said woven fabric comprises flocked film tape material.

13. A flexible intermediate bulk container, comprising a material suitable for defining an enclosing structure, said material at least partially comprising fibers having an effective length of less than about 10 mm, said effective length being defined by an amount by which said fibers protrude from an outer surface of the material, said effective length being at least a portion of a total length of said fibers, said fibers having an electric resistance in a range of about $10^8$ to about $10^{12}$ ohm/cm.

14. A flexible intermediate bulk container according to claim 13, wherein said material is selected from the group consisting of a coated woven fabric, an uncoated woven fabric and a plastics film.

15. A flexible intermediate bulk container according to claim 14, wherein the fibers are no less electrostatically dissipative than a remainder of said material.

16. A flexible intermediate bulk container according to claim 13, wherein:

the material comprises a woven fabric; and the fibers protrude from yarns which are woven into the woven fabric.

17. A flexible intermediate bulk container according to claim 16, wherein the fibers are at least one of engaged between, flocked to and laterally providing from the yarns which are woven into the woven fabrics.

18. A flexible intermediate bulk container according to claim 13, wherein the fibers are one of flocked to the surface of, and incorporated in, said material.

19. A flexible intermediate bulk container according to claim 13, wherein: the electrical resistance of said fibers is no greater than the electrical resistance of the remainder of the material.

20. A flexible intermediate bulk container according to claim 13, wherein;

the material comprises a plastics film; and the fibers are held to said plastics film by an antistatic layer of glue.

21. The flexible intermediate bulk container of claim 20 wherein said woven fabric comprises flocked film tape material.

22. A flexible intermediate bulk container, comprising a material suitable for defining an enclosing structure, said material comprising a woven fabric at least partially including fibers having an effective length of less than about 10 mm, said effective length being defined by an amount by which said fibers protrude from an outer surface of the material, said effective length being at least a portion of a total length of said fibers, the woven fabric at least partially comprising flocked film tape material.

23. A flexible intermediate bulk container comprising:

coated or uncoated woven fabric or plastics film, said fabric or film including antistatic properties and being provided with elements, said elements being enabled for corona discharge of static electricity accumulating in said flexible intermediate bulk container; and said woven fabric or plastics film comprising fibers with a length of less than 10 mm, said fibers having an electric resistance in a range of about $10^8$ to about $10^{12}$ ohm/cm.

24. A flexible intermediate bulk container comprising:

coated or uncoated woven fabric or plastics film, said film or basic weave of said fabric being nonconductive;

said fabric or film being provided with elements, said elements being enabled for corona discharge of static electricity accumulating in said flexible intermediate bulk container; and a surface of said fabric or film comprising fibers protruding less than 10 mm from the surface, said fibers including an electric resistance in a range of about $10^8$ to about $10^{12}$ ohm/cm.

25. A flexible intermediate bulk container comprising:

coated or uncoated woven fabric or plastics film, said film or basic weave of said fabric being nonconductive;

said fabric or film being provided with elements, said elegies being enabled for corona discharge of static electricity accumulating in said flexible intermediate bulk container; and said fabric or film comprising fibers with a length of less than 10 mm, said fibers including an electric resistance in a range of about $10^8$ to about $10^{12}$ ohm/cm.

26. A flexible intermediate bulk container comprising:

coated or uncoated woven fabric or plastics film, said film or basic weave of said fabric being nonconductive;

said fabric or film being provided with elements, said elements being enabled for corona discharge of static electricity accumulating in said flexible intermediate bulk container; and said woven fabric or plastics film comprising fibers with a length of less than 10 mm, said fibers having an electric resistance in a range of about $10^8$ to about $10^{12}$ ohm/cm.

27. A flexible intermediate bulk container comprising:

coated or uncoated woven fabric or plastics film;

said fabric or film comprising a plurality of yarn, said yarn being twisted to form a core and an exterior surface, the twisted yarn defining slits, said slits passing through said core and forming openings on said exterior surface; and a plurality of antistatic fibers, each fiber passing through said yarn core and protruding from said openings;

said fabric or film including antistatic properties and said fibers being enabled for corona discharge of static electricity accumulating in said flexible intermediate bulk container; and said fibers protruding less than 10 mm from said exterior surface, said fibers including an electric resistance in a range of about $10^8$ to about $10^{12}$ ohm/cm.

28. A flexible intermediate bulk container comprising;

coated or uncoated woven fabric or plastics film;

said fabric or film comprising a plurality of yarn, said yarn being twisted to form a care and an exterior surface, the twisted yarn defining slits, said slits passing through said core and forming openings on said exterior surface;

a plurality of antistatic fibers, each fiber passing through said yarn core and protruding from said openings;

said fabric or film including antistatic properties and said fibers being enabled for corona discharge of static electricity accumulating in said flexible intermediate bulk container; and said fibers having a length of less than 10 mm, said fibers including an electric resistance in a range of about $10^8$ to about $10^{12}$ ohm/cm.

29. A flexible intermediate bulk container comprising:

coated or uncoated woven fabric or plastics film;

said fabric or film comprising a plurality of yarn, said yarn being twisted to form a core and an exterior surface, the twisted yarn defining slits, said slits passing through said core and forming openings on said exterior surface;

a plurality of antistatic fibers, each fiber passing through said yarn core and protruding from said openings;

said fabric or film including antistatic properties and said fibers being enabled for corona discharge of static electricity accumulating in said flexible intermediate bulk container; and wherein said fibers protrude from said openings by less than 10 mm, said fibers having an electric resistance in a range of about $10^8$ to about $10^{12}$ ohm/cm.

30. A flexible intermediate bulk container comprising:

coated or uncoated woven fabric or plastics film, said film or basic weave of said fabric being nonconductive;

said fabric or film comprising a plurality of yarn, said yarn being twisted to form a core and an exterior surface, the twisted yarn defining slits, said slits passing trough said core and forming openings on said exterior surface;

a plurality of antistatic fibers, each fiber passing through said yarn core and protruding from said openings;

said fabric or film including antistatic properties and said fibers being enabled for corona discharge of static electricity accumulating in said flexible intermediate bulk container; and said fibers having with a length of less than 10 mm, said fibers having an electric resistance in a range of about $10^8$ to about $10^{12}$ ohm/cm.

* * * * *